US010627154B2

(12) United States Patent
Chen et al.

(10) Patent No.: US 10,627,154 B2
(45) Date of Patent: Apr. 21, 2020

(54) REFRIGERATOR

(71) Applicant: BSH HAUSGERAETE GMBH, Munich (DE)

(72) Inventors: Jinghui Chen, Nanjing (CN); Xiangfan Guo, Nanjing (CN); Wuba Lei, Anhui (CN); Zhihui Zhou, Nanjing (CN)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 16/289,715

(22) Filed: Mar. 1, 2019

(65) Prior Publication Data

US 2019/0277556 A1 Sep. 12, 2019

(30) Foreign Application Priority Data

Mar. 6, 2018 (CN) ..... 2018 1 0181404

(51) Int. Cl.
*F25D 23/06* (2006.01)

(52) U.S. Cl.
CPC ..... *F25D 23/067* (2013.01); *F25D 23/062* (2013.01); *F25D 23/069* (2013.01); *F25D 2201/126* (2013.01); *F25D 2400/04* (2013.01)

(58) Field of Classification Search
CPC .... F25D 23/062; F25D 23/065; F25D 23/067; F25D 23/069; F25D 23/085; F25D 2400/04
See application file for complete search history.

(56) References Cited

U.S. PATENT DOCUMENTS 4,358,213 A * 11/1982 Hawkins ..... F16B 12/28 403/205
4,558,503 A * 12/1985 Wilson ..... B23P 15/26 29/446
4,822,117 A * 4/1989 Boston, Jr. ..... F25D 23/062 29/455.1

(Continued)

FOREIGN PATENT DOCUMENTS

CN 103673453 A 3/2014
EP 1566603 A1 * 8/2005 ..... F25D 23/065

(Continued)

OTHER PUBLICATIONS

Translated Description CN103673453A, 9 pages. (Year: 2014).*

*Primary Examiner* — Andrew M Roersma
(74) *Attorney, Agent, or Firm* — Laurence A. Greenberg; Werner H. Stemer; Ralph E. Locher

(57) ABSTRACT

A refrigerator has a case body with a pair of side walls, a beam bridge-connecting the pair of side walls, where the beam includes a housing, and the housing has an accommodation space and a heat insulation material located in the accommodation space. A strengthening member is fastened to a corresponding side wall, where the strengthening member is mounted in the accommodation space, and includes a main plate portion extending along a front inner wall of the accommodation space and a side plate portion extending backward from at least one side of the main plate portion. The housing has a support portion protruding backward from the front inner wall, and the side plate portion is provided with an anti-flipping portion abutting against the support portion.

12 Claims, 4 Drawing Sheets

(56) References Cited

U.S. PATENT DOCUMENTS

| | | | | |
|---|---|---|---|---|
| 4,955,676 | A * | 9/1990 | Weaver | F25D 23/069 312/236 |
| 6,350,002 | B1 * | 2/2002 | Takaoka | A47B 47/02 220/592.02 |
| 7,014,283 | B2 * | 3/2006 | Grace | F25D 23/062 312/406 |
| 7,410,230 | B2 * | 8/2008 | Anderson | F25D 23/065 312/401 |

FOREIGN PATENT DOCUMENTS

| | | | | |
|---|---|---|---|---|
| WO | WO-2012025560 | A2 * | 3/2012 | F25D 23/065 |
| WO | WO-2015131771 | A1 * | 9/2015 | F25D 23/065 |

* cited by examiner

REFRIGERATOR

CROSS-REFERENCE TO RELATED APPLICATION

This application claims the priority, under 35 U.S.C. § 119, of Chinese application CN 2018 1018 1404.3, filed Mar. 6, 2018; the prior application is herewith incorporated by reference in its entirety.

BACKGROUND OF THE INVENTION

Field of the Invention

The present invention relates to a refrigerator, and in particular, to a refrigerator having a beam.

A front side of a case body of a refrigerator is provided with a beam bridge-connecting two side walls of the case body, to divide a space defined by an inner container into two portions. An upper door and a lowerdoor of the refrigerator separately abut against the beam when the doors are closed. To avoid a coldness leakage of the refrigerator, a heat insulation material is usually provided in the beam. For example, a common heat insulation material includes an EPS plate (a polystyrene foam plate) or a PU foam material (a monocomponent polyurethane foam sealant is commonly known as a foaming agent).

A reference document, namely Chinese patent application ON 103 673 453 A, discloses a beam applied to a refrigerator. Strengthening members connected to side walls of a case body are disposed at ends of the beam, to strengthen the strength of the beam.

SUMMARY OF THE INVENTION

An objective of the present invention is to provide an improved refrigerator.

A refrigerator according to the present invention includes a case body, where the case body has a pair of side walls and a beam bridge-connecting the pair of side walls, where the beam includes a housing. The housing has an accommodation space and a heat insulation material located in the accommodation space. A strengthening member is fastened to a corresponding side wall, where the strengthening member is mounted in the accommodation space, and includes a main plate portion extending along a front inner wall of the accommodation space and a side plate portion extending backward from at least one side of the main plate portion. The housing has a support portion protruding backward from the front inner wall, and the side plate portion is provided with an anti-flipping portion abutting against the support portion.

According to the solution in the embodiments of the present invention, the coordination between the support portion and the anti-flipping portion can further improve the strength of the beam, and particularly, facilitate improvement of an anti-flipping capability of the beam during bearing.

Preferably, the side plate portion includes a first plate extending horizontally, and the anti-flipping portion is located at an end portion of the first plate. This particularly facilitates improvement of the anti-flipping capability of the beam.

Preferably, the side plate portion includes a second plate, there is a gap between the second plate and the support portion in a height direction of the refrigerator, and there is a heat insulation material n the gap. In this way, the strength of the beam is further improved.

Preferably, the second plate is provided with a foam catching portion in a front-rear direction, and the foam catching portion is located between the anti-flipping portion and the main plate portion. The foam catching portion enables the heat insulation material to closely connect the strengthening member and the beam.

Preferably, the foam catching portion has at least one hole for a foaming material used to form a heat insulation material to pass through. The hole on the foam catching portion enables the heat insulation material to wrap the strengthening member more adequately, so that a foam beam and the strengthening member are better combined.

Preferably, there is a gap between the anti-flipping portion and the main plate portion in a front-rear direction. The anti-flipping portion is not connected to the main plate portion. When the main plate is mounted on the front inner wall, the main plate does not affect abutting between the anti-flipping portion and the support portion.

Preferably, the support portion includes at least two support ribs that protrude backward from the front inner wall and that are disposed at an interval. The support portion can abut against and coordinate with the anti-flipping portion better by using a symmetrical design.

Preferably, the beam includes a pair of support portions disposed opposite to each other, where the strengthening member includes a side plate portion connected to a corresponding side of the main plate portion, and the anti-flipping portion is located between the pair of support portions and abuts against a corresponding support portion. Two anti-flipping portions respectively abut against a pair of support portions, so that the strengthening member can be steadily mounted in the housing, and no displacement occurs.

Preferably, the front inner wall has a groove, the main plate portion is located in the groove, and there is a gap between the support portion and the groove in a height direction of the refrigerator.

Preferably, the strengthening member includes a first end extending beyond the accommodation space, the housing includes a hook located in the accommodation space, and a second end opposite to the first end on the strengthening member is fastened in the accommodation space by using the hook.

Preferably, the front inner wall is provided with a positioning pin; the main plate portion is provided with a positioning hole; and the positioning hole engages with the positioning pin to position the strengthening member to the front inner wall.

Preferably, the first end and the second end of the strengthening member each are provided with a mounting hole.

According to another aspect of the present invention, a refrigerator is provided, including the foregoing beam.

Other features which are considered as characteristic for the invention are set forth in the appended claims.

Although the invention is illustrated and described herein as embodied in a refrigerator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

The following describes the present invention in detail with reference to the accompanying drawings and embodiments. It should be noted that the embodiments of this application and features of the embodiments can be combined with each other without conflict.

Figure 1:
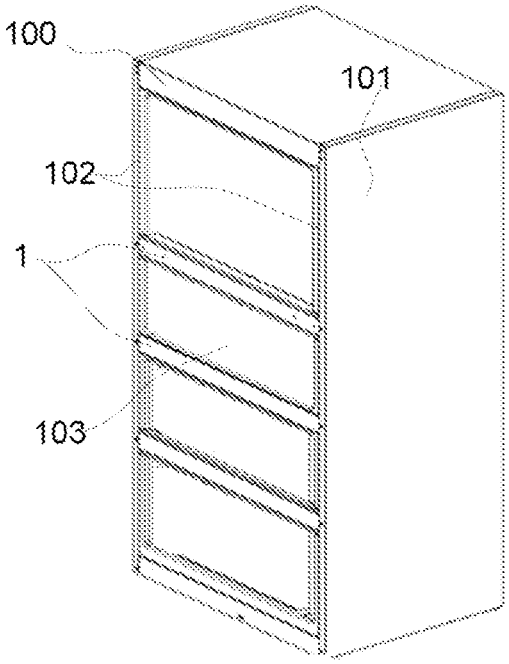
FIG. 1 is a diagrammatic, perspective view of a refrigerator according to an embodiment of the present invention, where no door is shown.

Referring now to the figures of the drawings in detail and first, particularly to FIG. 1 thereof, there is shown a refrigerator 100 includes a case body 101, where the case body 101 has a pair of side walls 102; and a beam 1 bridge-connecting the pair of side walls 102. The case body 101 has at least one storage room 103.

The beam 1 includes a housing 2. The housing 2 has an accommodation space 10 and a non-illustrated heat insulation material located in the accommodation space 10. In an embodiment, the heat insulation material may be formed by a foaming agent injected into the accommodation space 10.

Figure 2:
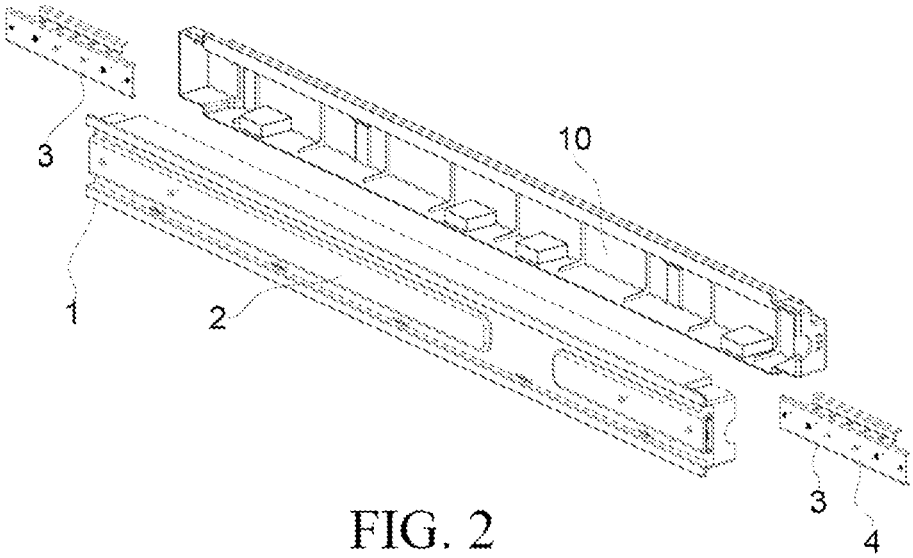
FIG. 2 is an exploded, perspective view of a beam according to an embodiment of the present invention.
Figure 3:
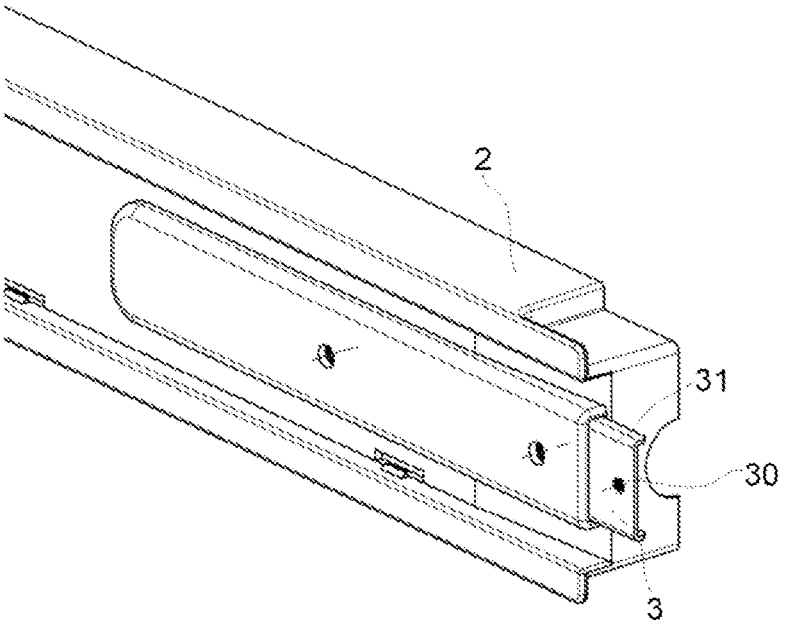
FIG. 3 is a first perspective view of a structural diagram of the beam according to an embodiment of the present invention.
Figure 4:
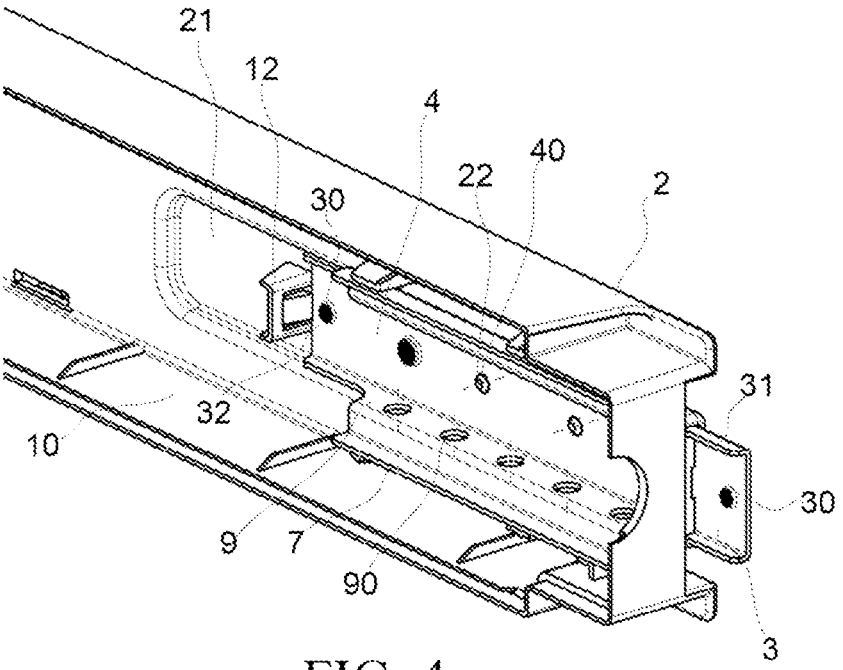
FIG. 4 is a second perspective structural diagram of the beam according to an embodiment of the present invention.

As shown in FIG. 2, FIG. 3, and FIG. 4, the beam 1 includes a strengthening member 3. In this embodiment, two ends of the beam 1 each are provided with a strengthening member 3, and each strengthening member 3 is fastened to a corresponding side wall 102. It should be understood that in an alternative embodiment, the beam 1 is provided with a strengthening member 3, and two ends 31 and 32 of the strengthening member 3 are respectively fastened to corresponding side walls 102.

The strengthening member 3 is mounted in the accommodation space 10, and includes a main plate portion 4 extending along a front inner wall of the accommodation space 10 and a side plate portion 5 extending backward from at least one side of the main plate portion 4.

The strengthening member 3 includes a first end 31 extending beyond the accommodation space 10. In this embodiment, the first end 31 is located at an end of the main plate portion 4. The first end 31 is provided with a mounting hole 30 for a fixing member (for example, a screw) configured to fasten the beam 1 to the side wall 102 to pass through, so that the strengthening member 3 is fastened to the side wall 102.

As shown in FIG. 3, during mounting, the first end 31 of the strengthening member 3 extends beyond the accommodation space 10. The housing 2 includes a hook 12 located in the accommodation space 10. A second end 32 opposite to the first end 31 on the strengthening member 3 is fastened in the accommodation space 10 by using the hook 12. In this way, a screw is not necessary in assembling, thereby reducing use of parts, and improving the assembling efficiency.

Figure 5:
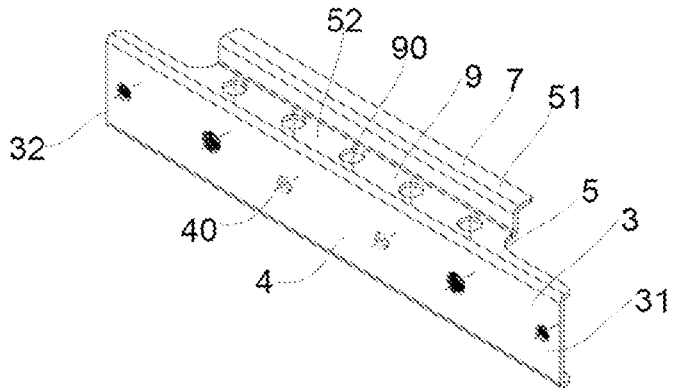
FIG. 5 is a perspective view of the strengthening member according to an embodiment of the present invention.
Figure 6:
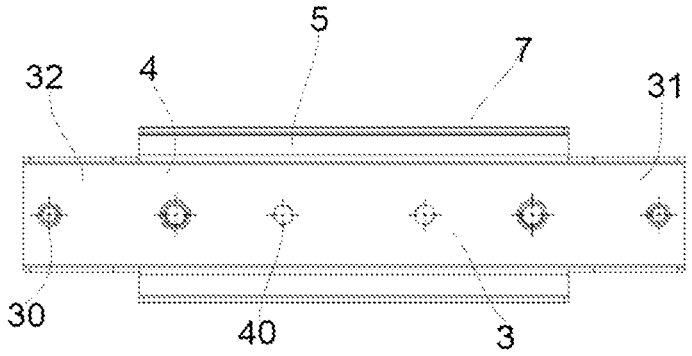
FIG. 6 is a first side view of the strengthening member according to an embodiment of the present invention.

Preferably, as shown in FIG. 5 and FIG. 6, the first end 31 and the second end 32 of the strengthening member 3 each are provided with a mounting hole 30. The design of symmetrical mounting holes makes the first end 31 and the second end 32 identical during mounting, thereby avoiding inconvenience caused due to adjustment of incorrect mounting.

The housing 2 has a support portion 6 protruding backward from the front inner wall 21. The side plate portion 5 is provided with an anti-flipping portion 7 abutting against the support portion 6. The coordination between the support portion 6 and the anti-flipping portion 7 can improve the strength of the beam 1, and particularly, improve the anti-flipping strength of the beam 1 during bearing.

Figure 8:
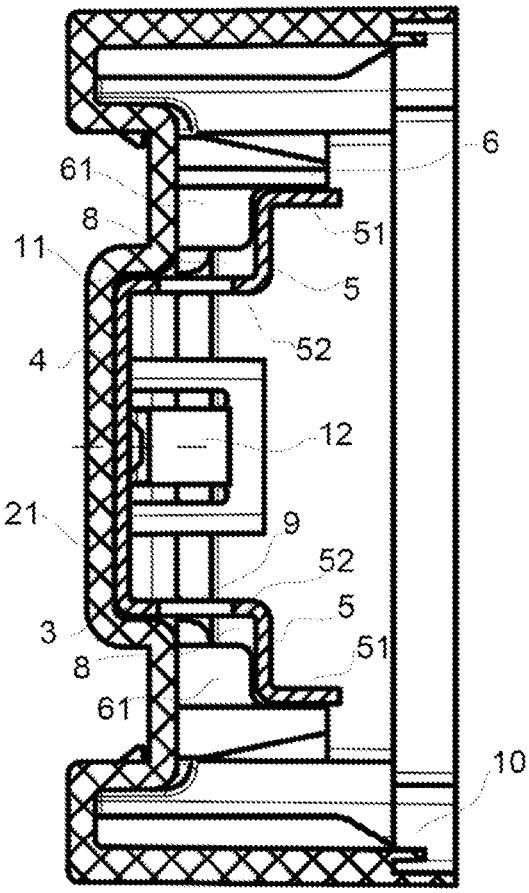
FIG. 8 is a diagrammatic, cross-sectional view of the beam according to an embodiment of the present invention.

As shown in FIG. 8, the beam 1 includes a pair of support portions 6 disposed opposite to each other. The strengthening member 3 includes a side plate portion connected to a corresponding side of the main plate portion 4. The anti-flipping portion 7 is located between the pair of support portions 6 and abuts against a corresponding support portion 6. Two anti-flipping portions 7 respectively abut against a pair of support portions 6, so that the strengthening member 3 can be steadily mounted in the housing 2, and no displacement occurs.

The support portion 6 includes at least two support ribs 61 that protrude backward from the front inner wall 21 and that are disposed at an interval. The support portion 6 can abut against and coordinate with the anti-flipping portion 7 better by using a symmetrical design.

Figure 7:
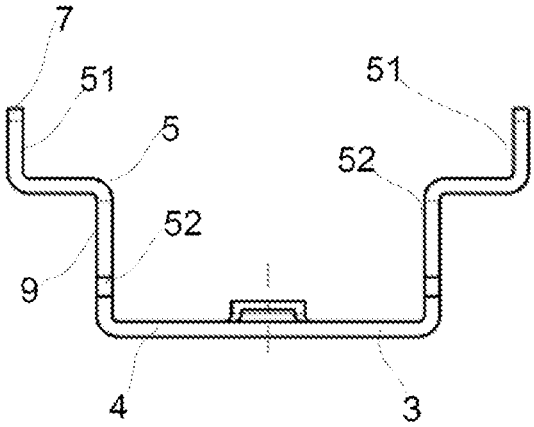
FIG. 7 is a second side view of the strengthening member according to an embodiment of the present invention.

Preferably, as shown in FIG. 4, FIG. 7, and FIG. 8, the side plate portion 5 includes a first plate 51 extending horizontally, and the anti-flipping portion 7 is located at an end of the first plate 51. The side plate portion 5 further includes the second plate 52. There is a gap 8 between the second plate 52 and the support portion 6 in a height direction of the refrigerator. The gap 8 has a heat insulation material. There is a gap between the anti-flipping portion 7 and the main plate portion 4 in a front-rear direction, and the anti-flipping portion 7 and the main plate portion 4 are not connected.

The first plate 51 and the second plate 52 may be connected in a "Z" shape. The first plate 51 is connected to the support portion 6. There is a gap 8 between the second plate 52 and the support portion 6. A heat insulation material is filled in the gap 8 to ensure steady mounting of the strengthening member 3.

Preferably, as shown in FIG. 7 and FIG. 8, the second plate 52 is provided with a foam catching portion 9 in a front-rear direction, and the foam catching portion 9 is located between the anti-flipping portion 7 and the main plate portion 4. The foam catching portion 9 has at least one hole 90 for a foaming material used to form a heat insulation material to pass through. The hole 90 on the foam catching portion 9 enables the heat insulation material to wrap the strengthening member more adequately, so that the housing 2 and the strengthening member 3 are better combined closely.

Preferably, as shown in FIG. 8, the front inner wall 21 has a groove 11, the main plate portion 4 is located in the groove 11, and there is a gap between the support portion 6 and the groove 11 in a height direction of the refrigerator.

Preferably, as shown in FIG. 4 and FIG. 5, the front inner wall 21 is provided with a positioning pin 22, the main plate portion 4 is provided with a positioning hole 40, and the positioning hole 40 engages with the positioning pin 22 to position the strengthening member 3 to the front inner wall 21.

Various specific implementations described above and shown in the accompanying drawings are merely used for the purpose of describing the present invention, and are not all implementations of the present invention. Within the basic technical idea scope of the present invention, any form of modifications made by a person of ordinary skill in the related art on the present invention shall fall within the protection scope of the present invention.

The invention claimed is:

1. A refrigerator, comprising:

a case body having a pair of side walls;

a beam bridge-connecting said pair of side walls, said beam having a housing, said housing defining an accommodation space and a heat insulation material disposed in said accommodation space;

a strengthening member fastened to a corresponding one of said side walls, said strengthening member mounted in said accommodation space and having a main plate portion extending along a front inner wall of the accommodation space and a side plate portion extending backward from at least one side of said main plate portion;

said housing having a front inner wall and a support portion protruding backward from said front inner wall; and said side plate portion of said strengthening member having an anti-flipping portion abutting against said support portion of said housing, said side plate portion having a first plate extending horizontally, and said anti-flipping portion being disposed at an end portion of said first plate;

said side plate portion having a second plate;

a gap being defined between said second plate and said support portion in a height direction of the refrigerator; and said heat insulation material being disposed in said gap.

2. The refrigerator according to claim 1, wherein said second plate has a foam catching portion in a front-rear direction, and said foam catching portion is disposed between said anti-flipping portion and said main plate portion.

3. The refrigerator according to claim 2, wherein said foam catching portion has at least one hole formed therein and being a pass through for an insulating foaming material.

4. The refrigerator according to claim 1, wherein formed between said anti-flipping portion and said main plate portion in a front-rear direction is a gap.

5. The refrigerator according to claim 1, wherein said support portion has at least two support ribs that protrude backward from said front inner wall and are disposed at an interval.

6. The refrigerator according to claim 1, wherein:

said support portion is one of a pair of support portions disposed opposite to each other;

said side plate portion of said strengthening member is connected to a corresponding side of said main plate portion; and said anti-flipping portion is disposed between said pair of support portions and abuts against a corresponding one of said support portions.

7. The refrigerator according to claim 1, wherein said front inner wall has a groove formed therein, said main plate portion is disposed in said groove, and between said support portion and said groove in a height direction of the refrigerator is a gap.

8. The refrigerator according to claim 1, wherein:

said strengthening member has a first end extending beyond said accommodation space;

said housing has a hook disposed in said accommodation space; and said strengthening member has a second end opposite to said first end and is fastened in said accommodation space by using said hook.

9. The refrigerator according to claim 1, wherein:

said front inner wall has a positioning pin;

said main plate portion has a positioning hole formed therein; and said positioning hole engages with said positioning pin to position said strengthening member to said front inner wall.

10. The refrigerator according to claim 8, wherein said first end and said second end of said strengthening member each has a mounting hole formed therein.

11. The refrigerator according to claim 1, wherein said side plate portion has a first plate extending horizontally and defining a terminal end of said side plate portion, and said anti-flipping portion is disposed at said terminal end portion of said first plate.

12. The refrigerator according to claim 1, wherein said side plate portion has a substantially Z-shaped cross-section.

* * * * *